US005709421A

United States Patent [19]

Gillham

[11] Patent Number: 5,709,421

[45] Date of Patent: Jan. 20, 1998

[54] ELECTROMAGNETIC LOCKING DEVICES

[75] Inventor: Peter James Gillham, Cranbrook, United Kingdom

[73] Assignee: Newman Tonks Group P.L.C., United Kingdom

[21] Appl. No.: 649,608

[22] PCT Filed: Sep. 22, 1995

[86] PCT No.: PCT/GB95/02253

§ 371 Date: May 24, 1996

§ 102(e) Date: May 24, 1996

[87] PCT Pub. No.: WO96/10122

PCT Pub. Date: Apr. 4, 1996

[30] Foreign Application Priority Data

Sep. 27, 1994 [GB] United Kingdom ..... 9419404

[51] Int. Cl.[6] ..... E05C 19/16

[52] U.S. Cl. ..... 292/251.5; 292/254; 292/DIG. 72

[58] Field of Search ..... 292/251.5, 201, 292/144, DIG. 72, 254

[56] References Cited

U.S. PATENT DOCUMENTS

| | | | |
|---|---|---|---|
| 3,533,652 | 10/1970 | Crane et al. | 292/251.5 |
| 4,026,588 | 5/1977 | Bisbing et al. | 292/251.5 |
| 4,720,128 | 1/1988 | Logan, Jr. et al. | 292/251.5 |
| 4,915,431 | 4/1990 | Bailey . | |
| 4,981,312 | 1/1991 | Frolov | 292/251.5 |
| 5,000,497 | 3/1991 | Geringer et al. . | |
| 5,033,779 | 7/1991 | Geringer et al. . | |
| 5,139,293 | 8/1992 | Zimmerman et al. | 292/251.5 |
| 5,485,733 | 1/1996 | Hoffman | 292/251.5 |

FOREIGN PATENT DOCUMENTS

| | | |
|---|---|---|
| 1 254 687 | 1/1961 | France . |
| 2 621 349 | 4/1989 | France . |
| 1184 | 12/1911 | United Kingdom . |

*Primary Examiner*—Rodney M. Lindsey
*Attorney, Agent, or Firm*—Kirschstein, et al.

[57] ABSTRACT

An electromagnetic locking device comprises an actuating assembly including an electromagnet having an operative face and at at least one side thereof an abutment which extends in a direction substantially perpendicular to the operative face and projects beyond the operative face, and a cooperative assembly including armature mounted for movement towards and away from the operative face in a direction substantially perpendicular thereto when the electromagnet and armature are aligned and arranged so as to engage behind the abutment when the electromagnet is energized. The actuating assembly also includes at least one plunger which is mounted for movement substantially perpendicularly to the operative face between a retracted position and an extended position relative to the operative face and spring washers for driving the plunger into its extended position into contact with said armature to displace the armature clear of said abutment when the electromagnet ceases to be energized. The plunger is provided adjacent to one side of the electromagnet, namely that at which the abutment is provided, and the armature is mounted on a pivot so as to allow the armature to move progressively onto the electromagnet across the width thereof as the electromagnet is energized.

8 Claims, 2 Drawing Sheets

ELECTROMAGNETIC LOCKING DEVICES

BACKGROUND OF THE INVENTION

This invention relates to electromagnetic locking devices of the kind used, for example, in connection with security doors and fire doors to hold such doors closed under normal circumstances whilst allowing them to be released quickly in an emergency.

Basically there are two types of electromagnetic locking device used for such purposes, each including an electromagnet, which is normally mounted on a door frame, and a co-operating armature, which is normally mounted on the door itself, so that energisation of the electromagnet establishes a high attractive holding force on the armature which resists opening movement of the door relative to the door frame.

In the first type the armature is arranged in face-to-face relationship with the electromagnet so that the attractive force acts directly opposite to the direction in which the door moves away from the door frame when it is opened. In other words, the door is held closed purely by the electromagnetic force acting on the armature. Despite the fact that one or more electromagnetic locking devices of this kind can exert very high forces on the door, in the order of 350 kgf, such locking force can nevertheless be overcome by a shock load, as for example by kicking or a sledgehammer blow.

The other type overcomes this disadvantage by arranging the armature in an edge face of the door in such a manner that as a result of the attractive force generated by the facing electromagnet in the door frame, the armature is drawn towards the electromagnet so as to engage behind an abutment, usually in the form of a shear plate, which is associated with the electromagnet. When the electromagnet is energised the armature is retained behind the shear plate so that the door is mechanically locked. When the electromagnet is de-energised, the armature is free to retract under the force of an associated spring, thereby clearing the shear plate and allowing the door to be opened.

This second type of electromagnetic locking device therefore offers much greater security than the first type.

However, there is a potential problem with this type of electromagnetic locking device in that if a high static load is imposed on the door, in the direction required to open the door, as may happen for example in a panic situation where people are pressing against the door, the armature will tend to be frictionally held by the shear plate due to the force exerted on the armature which holds it against the shear plate.

SUMMARY OF THE INVENTION

It is an object of the present invention to provide such an electromagnetic locking device in which this disadvantage is overcome.

In accordance with the present invention we provide an electromagnetic locking device of the kind comprising an actuating assembly which includes an electromagnet having an operative face and at at least one side thereof an abutment which extends in a direction substantially perpendicular to said operative face and projects beyond said operative face, and a co-operative assembly which includes an armature mourned for movement towards and away from said operative face in a direction substantially perpendicular thereto when the electromagnet and armature are aligned and arranged so as to engage behind said abutment when the electromagnet is energised, characterised in that the armature is mounted so as to allow the armature pivotally to move progressively onto and off the electromagnet across the width thereof; and said actuating assembly includes at least one member adjacent to one side of the electromagnet and which is mounted for movement substantially perpendicularly to said operative face between a retracted position and an extended position relative to said operative face, and means for driving the member into its extended position out of contact with said armature to displace said armature out of contact with said electromagnet progressively across said operative face when said electromagnet ceases to be energised.

Thus, in accordance with the invention, when the electromagnet is de-energised, the co-operative armature is positively displaced away from the operative face of the electromagnet and clear of the abutment so that the armature cannot bind against the abutment if there is a force exerted on the door on which the device is installed and which could otherwise cause the armature to bind against the abutment.

The member driving means whereby the member is driven to its extended position may be operated by means of electrically, hydraulically or pneumatically powered systems, but preferably the driving force is provided by a passive system utilising an energy storage means, such as a compressible spring means. Preferably the member is a plunger slidably mounted in a bore in a core member of the electromagnet.

The progressive movement of the armature into contact with the electromagnet is especially advantageous because the force acting on the armature increases exponentially as the air gap between the electromagnet and the armature decreases, and without the progressively increasing force thus exerted by the armature on the plunger, the required compression of the spring means which serves as the energy storage means would otherwise be difficult to achieve.

Thus, energisation of the electromagnet draws the armature towards the operative face of the electromagnet and in so doing causes the armature to engage the plunger, which is initially in its extended position and as the armature is drawn progressively into contact with the armature to drive the plunger to its retracted position, whilst simultaneously compressing the spring means, thereby storing energy which can subsequently be released.

Preferably, the spring means is of a kind which provides a high force over a small distance of compression, such as one or more dished washers.

In accordance with another aspect of the invention, we provide an electromagnetic locking device of the kind comprising an actuating assembly which includes an electromagnet having an operative face and at at least one side thereof an abutment which extends in a direction substantially perpendicular to said operative face and projects beyond said operative face, and a co-operative assembly which includes an armature mounted for movement towards and away from said operative face in a direction substantially perpendicular thereto when the electromagnet and armature are aligned and arranged so as to engage behind said abutment when the electromagnet is energised, wherein said actuating assembly also includes at least one plunger which is mounted for movement substantially perpendicularly to said operative face between a retracted position and an extended position relative to said operative face and means for driving the plunger into its extended position into contact with said armature to displace said armature clear of said abutment when the electromagnet ceases to he energised.

The invention further resides in a door and frame assembly having a locking device in accordance with the invention installed thereon.

BRIEF DESCRIPTION OF THE DRAWINGS

These and other features of the invention will now be described by way of example with reference to the accompanying drawings wherein.

DETAILED DESCRIPTION OF THE PREFERRED EMBODIMENT

Figure 1A:
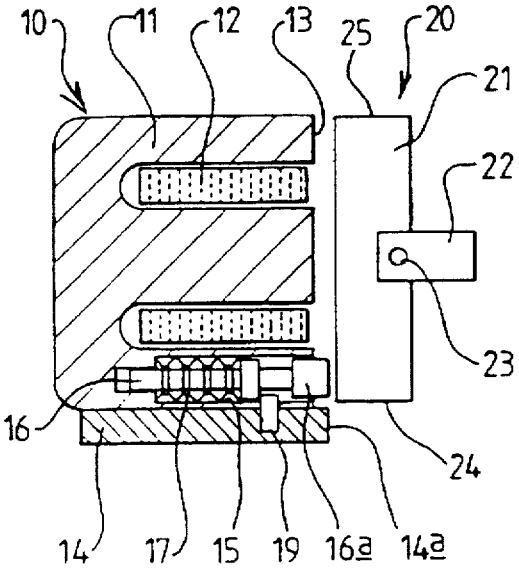
FIGS. 1*a*–1*d* illustrate successive stages in the actuation of a locking device in accordance with the invention.
Figure 1B:
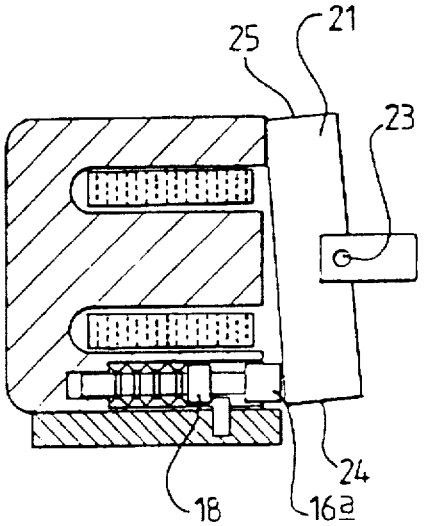
Figure 1C:
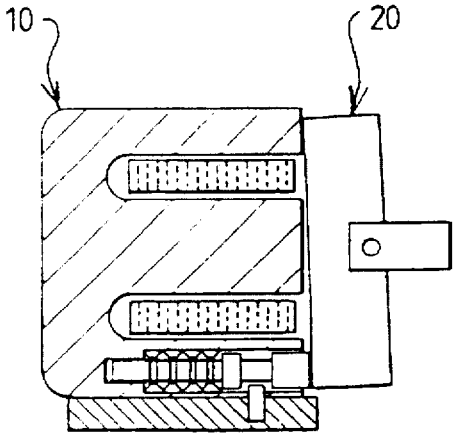
Figure 1D:
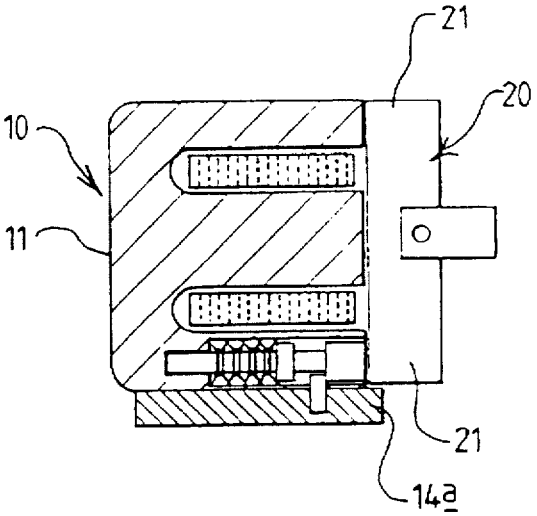
Figure 2:
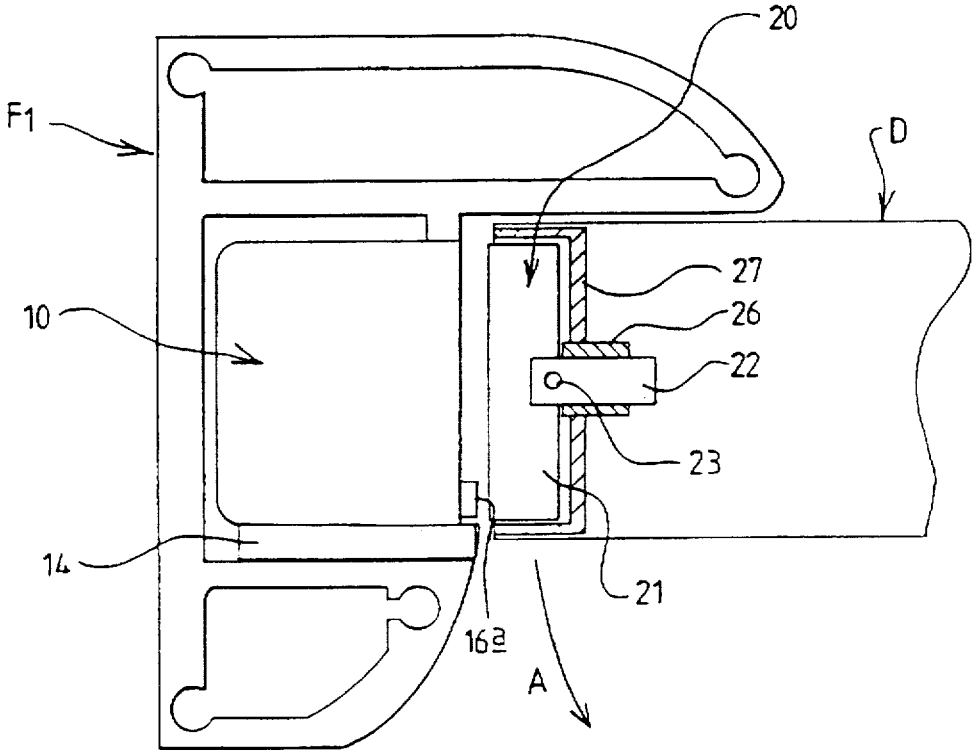
FIG. 2 illustrates such a device, in its unlocked condition, as installed in a door and frame assembly of the kind in which the door opens only to one side.

Referring first to FIG. 1, a locking device in accordance with the invention includes an actuator assembly 10 which is normally mounted in a door frame, and a co-operative assembly 20 which is normally mounted in an edge face of a door associated with the frame in such a manner that when the door is in its position of closure the assemblies 10 and 20 are aligned with one another, as illustrated in FIG. 2.

The actuator assembly 10 comprises an electromagnet 11, having in the illustrated embodiment an E-shaped core with an energising winding 12 on its central leg. The ends of the three legs are co-planar to define an operating face 13 which is presented towards the opening of the door frame.

Adjacent to one of the outermost legs of the core, the actuator assembly 10 includes a shear-plate 14 having an end portion 14*a* which projects beyond the operative face 13.

A bore 15 is formed in the leg of the core adjacent to the shear plate 14 and a plunger 16 is slidably received therein. The plunger 16 has a head portion 16*a* which normally protrudes from the bore and beyond the operative face 13, as illustrated in FIG. 1*a*. A stack of spring washers 17 act between the inner end of the bore and a collar 18 which is formed on a shank of the plunger 16. A stop pin 19 extends into the bore between the head 16*a* and collar 18 so as to limit axial movement of the plunger in both directions.

Figure 3:
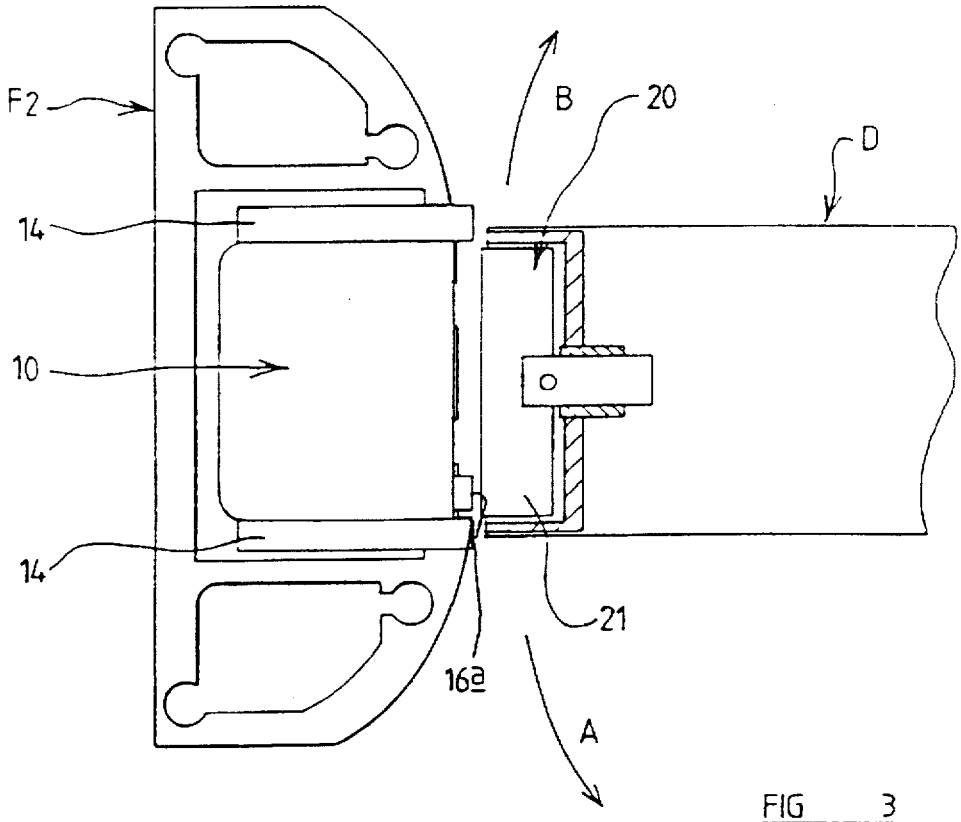
FIG. 3 is a similar view showing the device as installed in a door and frame assembly of the kind in which the door can open in both directions.

The co-operative assembly 20 comprises an armature plate 21 which is pivotally connected to a mounting member 22 by means of a pivot pin 23 arranged equi-distant from the opposed end faces 24, 25 of the plate 21. The mounting member 22 is slidably received in a bearing sleeve 26 carried by a housing 27 which is mounted within the edge face of a door D, as illustrated in FIGS. 2 and 3. A light spring (not shown) acts on the member 22 so as to urge the latter inwardly relative to the door and to draw the armature plate away from the edge of the door at which the assembly 20 is installed and hold it in a retracted position whilst the door is open.

When the door D is in its position of closure relative to the associated frame, the assemblies 10 and 20 are arranged in face-to-face relationship as shown in FIG. 1*a*. As can be seen, the armature plate 21 is spaced from the operative face 13 of the electromagnet 11 with sufficient clearance to enable the armature plate 21 to pass over the end portion 14*a* of the shear plate, thereby allowing the door to be moved to and from its position of closure without hindrance.

However, on energisation of the coil 12, the armature plate 21 is attracted towards the electromagnet 11, and initially the armature plate 21 moves towards the electromagnet 11 as the mounting member 22 slides in the bearing sleeve 26 against the force of the associated spring. However, the end 24 of the armature plate 21 engages the projecting head 16*a* of the plunger 16, so that the armature plate then pivots about pin 23 until the opposite end 25 thereof engages the electromagnet 11 on the side thereof remote from the shear plate 14, as illustrated in FIG. 1*b*.

Since the force exerted on the armature plate 21 increases exponentially as the air gap decreases, contact of the armature plate with the face 13 of the electromagnet at the end 25 thereof opposite the plunger 16 establishes a high force near the point of contact and the armature plate 21 then acts as a lever acting on the plunger against the force of the spring washer 17.

The armature plate 21 continues to move towards the electromagnet 11, pivoting about its point of contact with the core of the electromagnet, as illustrated in FIG. 1*c*, and driving the plunger 16 inwardly of the bore 15 so as to compress the spring washers 17, by virtue of the engagement of the head 16*a* of the plunger with the end 24 of the armature plate 21 nearest to the shear plate 14.

Such movement continues until the armature plate 21 is drawn into face-to-face engagement with the operative face 13 of the electromagnet 11, as seen in FIG. 1*d*, the plunger 16 being driven into the bore 15 so that the head 16 thereof is flush with the operative face 13 and the spring washers 17 are in a state of maximum compression.

The locking device remains in this condition whilst the coil 12 is energised, and the door is held closed and locked by engagement of the armature plate 21 behind the abutment constituted by the projecting end portion 14*a* of the shear plate 14.

When the coil 12 is de-energised, the electromagnetic force which holds the armature plate 21 against the operative face 13 of the core of the electromagnet 11 rapidly diminishes, and at a point at which the force exerted by the armature plate 21 on the head 16*a*, of the plunger 16 is no longer sufficient to hold the plunger in its retracted position, the plunger 16 is driven outwardly by the spring washers 17 under the force of the stored energy therein, with the result that the armature plate 21 is positively displaced away from the electromagnet 11, beginning at the edge thereof adjacent the shear plate 14, in the reverse sequence as compared with FIGS. 1*a*–1*d*.

The use of spring washers 17 as the energy storage means is especially desirable in that the spring characteristics give rise to rapid displacement of the plunger 16 with a 'snap' action, in a manner which is appropriate to overcome any binding force between the edge face of the armature plate 21 and the edge face of the projecting end portion 14*a* of the shear plate, which may arise from static loads exerted on the face of the door D.

The pivotal mounting of the armature plate 21 has two further advantages. Firstly, it allows the plate 21 initially to move away from the operative face 13 of the electromagnet at the end 24 thereof adjacent the shear plate 14 so as first to clear the projecting end portion 14*a* so that the door can immediately be opened in the escape direction even before the opposite end 25 of the armature plate 21 is released from the electromagnet. Secondly, the pivot pin 23 enables the armature plate 21 to be "peeled away" from the operative face 13 of the electromagnet in such a manner which facilitates overcoming any residual magnetic field operating between the core of the electromagnet 11 and the armature plate 21 which might otherwise tend to hold the armature plate 21 in contact with the operative face 13.

As shown in FIGS. 2 and 3, the locking device in accordance with the invention is installed in a door and frame assembly in such a manner that the shear plate 14 is arranged on the side to which the door D is intended to open in emergency, that is to say, in direction A. In the arrangement shown in FIG. 2 the door frame F1 is such that the door D open only in the direction A, whereas in FIG. 3 the door frame F2 is designed to enable the door to open either in direction A or in the opposite direction B. In this case, a second shear plate 14' is provided at the opposite side of the electromagnet 10 so that when the latter is energised the armature plate 21 is drawn into the space between the projecting end portions of the two shear plates 14, 14' and the door is held against opening in either direction. However, when the electromagnet is de-energised, the plunger 16 operates to disengage the armature plate 21 from the shear plate 14 on the side of the frame to which the door is required to open in an emergency, i.e. in direction A, rather than in direction B.

Whilst the plunger 16 is conveniently located in a bore formed in the core of the electromagnet, it will be understood that it could alternatively be arranged at a position adjacent to the electromagnet. Likewise, whilst the abutment which co-operates with the armature plate 21 to hold the door closed is preferably constituted by a projecting end portion **14*a* of the shear plate 14**, other arrangements are possible, for example the abutment could be formed as part of a casing for the electromagnet, or an adjacent part of a suitably reinforced door frame or a component mounted thereon in the manner of a keep for a conventional lock bolt.

The features disclosed in the foregoing description, or the accompanying drawings, expressed in their specific forms or in terms of a means for performing the disclosed function, or a method or process for attaining the disclosed result, or a class or group of substances or compositions as appropriate, may, separately or in any combination of such features be utilised for realising the invention in diverse forms thereof.

I claim:

1. An electromagnetic locking device, comprising: an actuating assembly including an energizable electromagnet having side faces and an operative face which extends transversely between said side faces of the electromagnet, an abutment adjacent to one of said side faces, said abutment extending in a direction substantially perpendicular to said operative face and projecting beyond said operative face, and a cooperative assembly including an armature mounted for movement towards and away from said operative face in a direction substantially perpendicular to said operative face when the electromagnet and the armature are aligned and arranged so as to engage behind said abutment when the electromagnet is energized, said armature being mounted so as to allow the armature pivotally to move progressively onto and off the electromagnet across said transversely extending operative face, said actuating assembly further including at least one member adjacent said one side face of the electromagnet at which the abutment is provided, said at least one member being mounted for movement in a direction substantially perpendicular to said operative face between a retracted position and an extended position relative to said operative face, and means for driving said at least one member into said extended position to displace said armature clear of said abutment and out of contact with said electromagnet progressively across said transversely extending operative face when the electromagnet ceases to be energized.

2. The device according to claim 1, wherein said at least one member comprises a plunger which is slidably mounted within a bore formed in a core of the electromagnet.

3. The device according to claim 2, wherein the means for driving comprises a passive system utilizing an energy storage means.

4. The device according to claim 3, wherein said energy storage means comprises compressible spring means.

5. The device according to claim 4, wherein said compressible spring means comprises at least one dished washer.

6. The device according to claim 1, wherein said abutment comprises an end portion of a shear plate which is secured to one lateral side of a core of the electromagnet.

7. The device according to claim 6, wherein a further shear plate is provided at the other of said side faces of the electromagnet which is opposite said one side face at which said first-mentioned shear plate is provided, said further shear plate comprising a second abutment at said other opposite side face to enable the device to be used with a door which is capable of opening in two directions.

8. A door and frame assembly having installed thereon an electromagnetic locking device comprising: an actuating assembly including an energizable electromagnet having side faces and an operative face which extends transversely between said side faces of the electromagnet, an abutment adjacent to one of said side faces, said abutment extending in a direction substantially perpendicular to said operative face and projecting beyond said operative face, and a cooperative assembly including an armature mounted for movement towards and away from said operative face in a direction substantially perpendicular to said operative face when the electromagnet and the armature are aligned and arranged so as to engage behind said abutment when the electromagnet is energized, said armature being mounted so as to allow the armature pivotally to move progressively onto and off the electromagnet across said transversely extending operative face, said actuating assembly further including at least one member adjacent said one side face of the electromagnet at which the abutment is provided, said at least one member being mounted for movement in a direction substantially perpendicular to said operative face between a retracted position and an extended position relative to said operative face, and means for driving said at least one member into said extended position to displace said armature clear of said abutment and out of contact with said electromagnet progressively across said transversely extending operative face when the electromagnet ceases to be energized.

* * * * *